US006914376B2

(12) United States Patent
Park

(10) Patent No.: US 6,914,376 B2
(45) Date of Patent: Jul. 5, 2005

(54) SUPPORTING FRAME STRUCTURE FOR TENSION-TYPE SHADOW MASK OF COLOR CRT

(75) Inventor: Yoon San Park, Gumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/986,680

(22) Filed: Nov. 9, 2001

(65) Prior Publication Data

US 2002/0063506 A1 May 30, 2002

(30) Foreign Application Priority Data

Nov. 27, 2000 (KR) ..... 2000/0070980

(51) Int. Cl.[7] ..... H01J 29/07; H01J 29/81
(52) U.S. Cl. ..... 313/407; 313/402
(58) Field of Search ..... 313/402, 407, 313/404, 364, 408, 461; 248/351, 357; 445/30

(56) References Cited

U.S. PATENT DOCUMENTS 5,644,192 A * 7/1997 Ragland, Jr. ..... 313/402
5,949,183 A * 9/1999 Saita et al. ..... 313/407
6,188,169 B1 * 2/2001 Takayanagi ..... 313/407
6,339,283 B1 * 1/2002 Horiuchi ..... 313/407
6,366,010 B1 * 4/2002 Suganuma et al. ..... 313/407
6,420,823 B1 * 7/2002 Tanaka ..... 313/402

FOREIGN PATENT DOCUMENTS

JP 09007528 A * 1/1997 ..... H01J/29/07
JP 10106449 A * 4/1998 ..... H01J/29/07
JP 10199440 A * 7/1998 ..... H01J/29/07
JP 11273586 A * 10/1999 ..... H01J/29/07

* cited by examiner

*Primary Examiner*—Mariceli Santiago
(74) *Attorney, Agent, or Firm*—Birch, Stewart, Kolasch & Birch, LLP

(57) ABSTRACT

A frame for supporting a tension-type shadow mask of a color CRT, which can increase the contact force of a damper wire at the peripheral portion of the shadow mask thus to improve the howling phenomenon is disclosed. The frame comprises a pair of first frames, each having a portion for supporting a shadow mask, respectively; and a pair of second frames combined with the first frames for applying elastic force to the shadow mask, wherein each of the portions for supporting in the first frames has inflection points where the curvature of the portions for supporting is increased at peripheral portions thereof after the first frames are compressed, for supporting the shadow mask and increasing a friction force for a damper wire at the periphery of the shadow mask.

4 Claims, 8 Drawing Sheets

SUPPORTING FRAME STRUCTURE FOR TENSION-TYPE SHADOW MASK OF COLOR CRT

BACKGROUND OF THE INVENTION

1. Field of the Invention

The present invention relates to a supporting frame structure for a tension-type shadow mask of a color CRT and particularly, to a supporting frame structure for a tension-type shadow mask of a color CRT, wherein the curvature of the supporting frame for a tension-type shadow mask supporting frame for a color CRT having upper and lower tensions in a form of a single curvature, changes to have a form of a poly-nomial after compression is added.

2. Description of the Background Art

FIG. 1 is a sectional view showing the conventional color CRT.

A front surface glass referred to as a panel 1, and a rear surface glass referred to as a funnel 2, are combined together. Inside the glasses is a fluorescent screen 4, an electron gun (not shown) which is a source of the electron beam 6 for hitting the fluorescent screen 4, a shadow mask 3 for selecting color to radiate a predetermined fluorescent material, and a frame 7 for supporting the shadow mask 3.

In addition, a spring 8 for combining the frame 7 to the panel 1 and an inner shield 9 for shielding so that the color CRT is influenced less by the external geomagnetism during the operation of the color CRT are fixed on the frame 7 in high-degree vacuum.

In the operation of the color CRT, the electron beam 6 hits the fluorescent screen 4 formed on the inner surface of the panel 1 by a bipolar voltage applied to the color CRT in the electron gun (not shown) built in the neck of the funnel 2. At this time, the electron beam 6 is deflected toward the upper, lower, left and right directions by a deflection yoke 5 before reaching the fluorescent screen 4, to thus form a screen.

Also, the frame 7 has a magnet with poles 2, 4 and 6 for adjusting the orbit of the electron beam 6 so that the electron beam 6 hits a certain fluorescent material pixel in the fluorescent screen 4 precisely.

The color CRT is under high-degree vacuum and accordingly breakage is occurs easily. Therefore, to prevent the breakage of the color CTR, the panel 1 is designed to have strength enough to endure atmospheric pressure. Also, the color CRT is provided with a reinforcing band 11 formed in the skirt portion of the panel 1, and accordingly, the color CRT is constructed to have a sufficient impact resistance by dispersing stress applied to the color CRT under high-degree vacuum.

FIGS. 2A and 2B are a perspective view showing a supporting frame structure for a shadow mask according to a conventional art and a structure of curvature of a main frame before compression on the main frame, respectively.

FIGS. 3A and 3B are a perspective view showing a supporting frame structure for a shadow mask according to a conventional art and a structure of curvature of a main frame after compression on the main frame, respectively.

As shown in FIG. 2A, a shadow mask assembly for a color CRT having upper and lower tensions comprises upper and lower main frames 11 for supporting the shadow mask, and a sub frame 12 which functions as an elastic suspending member and to which elastic force is applied in case of assembling the shadow mask by compressing the main frame 11 for fixing and supporting the main frame 11.

As shown in FIG. 2B, before compression is performed in the main frame 11 by forming a single curvature when the main frame 11 is compressed in order to prevent the shadow mask wrapping, the curvature of the main frame 11 conventionally has the form of poly-nomial.

As shown in FIGS. 3A and 3B, the radius of curvature of the main frame 11 after the compression in the main frame 11 can be identically formed to have a single curvature in every position, by forming a radius of curvature at the center of the main frame 11 smaller than that of curvature in a peripheral portion on both sides of the main frame 11 before the compression on the main frame 11.

Namely, as shown in FIG. 2B, when the size of a radius of curvature at the central portion in the main frame 11 is R1 and the size of a radius of curvature at the peripheral portion in the main frame 11 is R2, the structure of a radius of curvature satisfies the relation R1<R2.

FIGS. 4A, 4B and 4C are schematic views and graphs showing compression load and displacement according to a conventional art, and FIG. 5 is a detailed view showing a radius of curvature and curvature structure of a supporting frame structure for a shadow mask before and after frame compression according to conventional art.

As shown in FIGS. 4A, 4B and 5 compression load T is applied to the peripheral portions at the right and left sides more than 2 times greater than at the center when the main frame 11 is compressed and the shadow mask is assembled.

However, at the peripheral portions of the main frame 11, there is a sub frame 12 to which elastic force is applied and accordingly, the compression displacement δ is greater than 2 times at a center portion of the main frame 11 than at the peripheral portion.

Accordingly, to form the after-compression radius of curvature of the main frame 11 as a single curvature, the size of the after-compression radius of curvature of the main frame 11 at the central portion is smaller than that at the peripheral portion.

Namely, in case that the compression load at the center portion of the main frame 11 is T1, compression displacement at the center portion is δ 1, the compression loads at the left and right peripheral portions of the main frame 11 are T2 and compression displacements at the right and left peripheral portions of the main frame are δ 2, the relations T1<T2 and δ 1>δ 2 are satisfied.

FIG. 6 is a perspective view showing a structure combined with a general damper wires according to a conventional art.

As shown in FIG. 6, to improve howling characteristics generated by the vibration of a shadow mask at left and right peripheral portions, after compression and welding the shadow mask on a main frame 11, one to three damper wires 13 for reducing the vibration of the shadow mask 3 are attached to the shadow mask 3 in the horizontal direction (X direction) in the structure of the shadow mask assembly for a color CRT having upper and lower tensions.

The damper wires 13 are fixed to damper springs 14 having a certain tension and the damper springs are attached on side portions of the sub frame 12.

According to the howling characteristics, howling phenomenon is not recognizable since the center portion of the shadow mask 3 vibrates in Z direction and a screen change on which fluorescent material spreads and a landing change are not distinguishable.

However, at left and right peripheral portions of the shadow mask 3, the change in landing causes the howling phenomenon even though the shadow mask 3 vibrates a little and accordingly, damper wires 13 are attached to reduce the vibration of the shadow mask 3.

FIG. 7 is a schematic view showing elastic force of the conventional damper wire.

However, in a supporting frame structure for a conventional tension-type shadow mask of a color CRT, as shown in FIG. 7, in case that the aftercompression radius of curvature of the frame is formed in a structure of a single curvature, a problem of howling phenomenon occurs since compression force t1 on the shadow mask 3 is stronger at the center portion than t2 at the peripheral portions of the shadow mask 3. Also, in case of increasing the tension of the damper wires to improve the howling characteristics, the damper wires are easily broken because the thickness of the damper wires is as thin as 20~30 $\mu$m.

SUMMARY OF THE INVENTION

Therefore, an object of the present invention is to provide a supporting frame structure for a tension-type shadow mask of a color CRT which can improve howling characteristics by compressing a main frame by applying a curvature structure of a supporting frame structure for a shadow mask of a color CRT having upper and lower tensions as a single curvature and then increasing contact force by damper wire so that the curvature structure of the main frame is in the form of poly-nomial to solve the above problem and, which can reduce manufacturing costs of a supporting frame structure for a tension-type shadow mask.

To achieve these and other advantages and in accordance with the purpose of the present invention, as embodied and broadly described herein, there is provided a supporting frame structure for a tension-type shadow mask of a color CRT which includes a pair of main frames having a supporting part for supporting a shadow mask, respectively; and a pair of sub frames combined with the main frames for applying elastic force to the shadow mask; wherein the curvature structure of each one of the supporting parts in the main frames after the elastic force is removed satisfies the equation $\Delta R/R=0.95\sim1.05$, where R is a radius of curvature obtained by connecting a center of each one of the supporting parts in the main frames and both ends of each one of the supporting parts in the main frames, and $\Delta R$ is a radius of curvature obtained by connecting three arbitrary positions of each one of the supporting parts in the main frames.

Also, it is desirable that a curvature of each one of the supporting parts in the main frames has a radius of a poly-nomial on condition that elastic force is applied to the shadow mask.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, reference will now be made in detail to the preferred embodiments of the present invention, examples of which are illustrated in the accompanying drawings.

Figure 1:
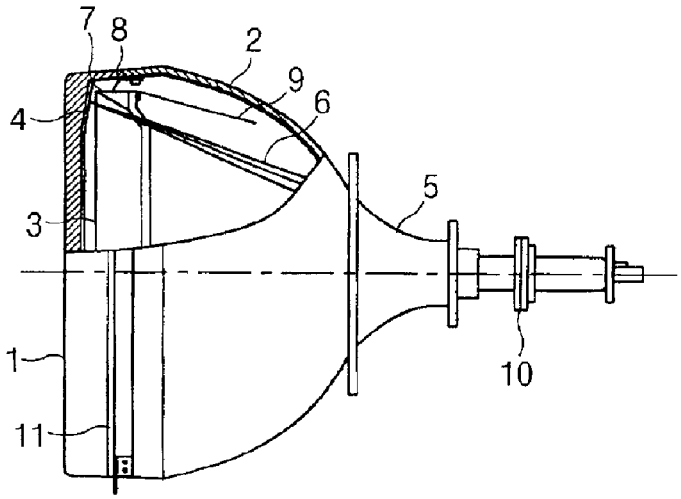
FIG.1 CONVENTIONAL ART
FIG. 1 is a sectional view showing a conventional color CRT.
Figure 2A:
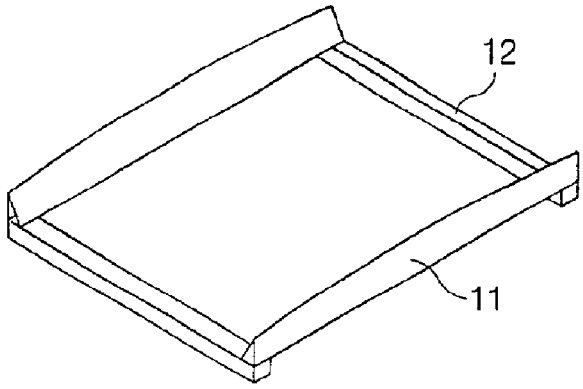
FIG.2A CONVENTIONAL ART
FIGS. 2A and 2B are a perspective view showing a supporting frame structure for a shadow mask according to a conventional art and a structure of curvature of a main frame before compression on the main frame, respectively.
Figure 2B:
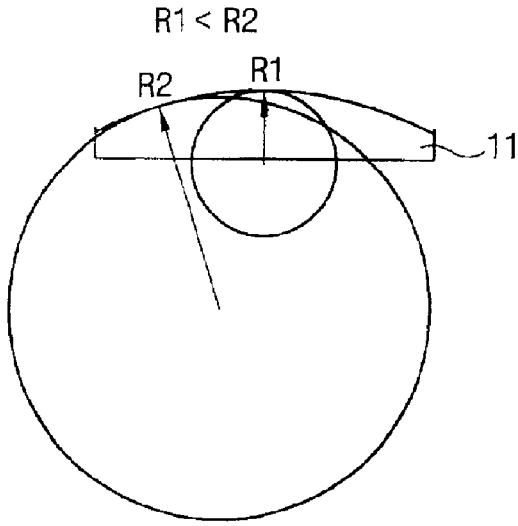
FIG.2B CONVENTIONAL ART
Figure 3A:
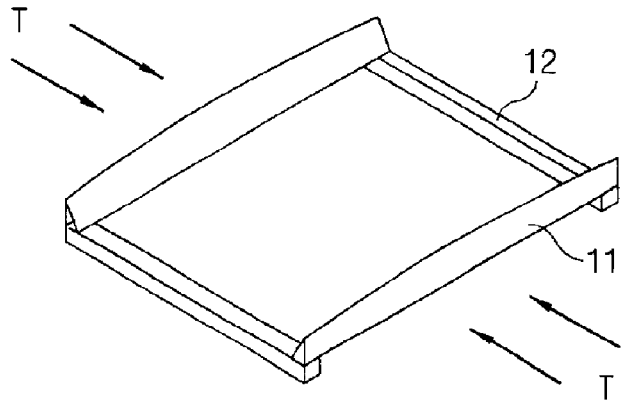
FIG.3A CONVENTIONAL ART
FIGS. 3A and 3B are a supporting frame structure for a shadow mask according to a conventional art and a structure of curvature of a main frame after compression on the main frame, respectively.
Figure 3B:
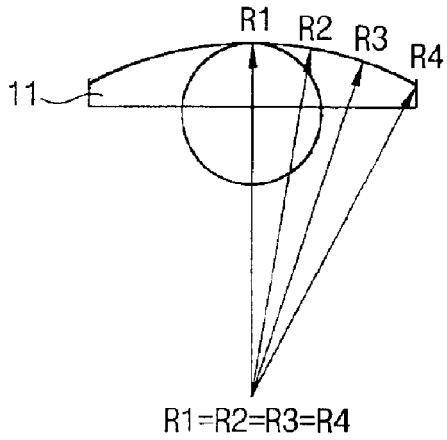
FIG.3B CONVENTIONAL ART
Figure 4A:
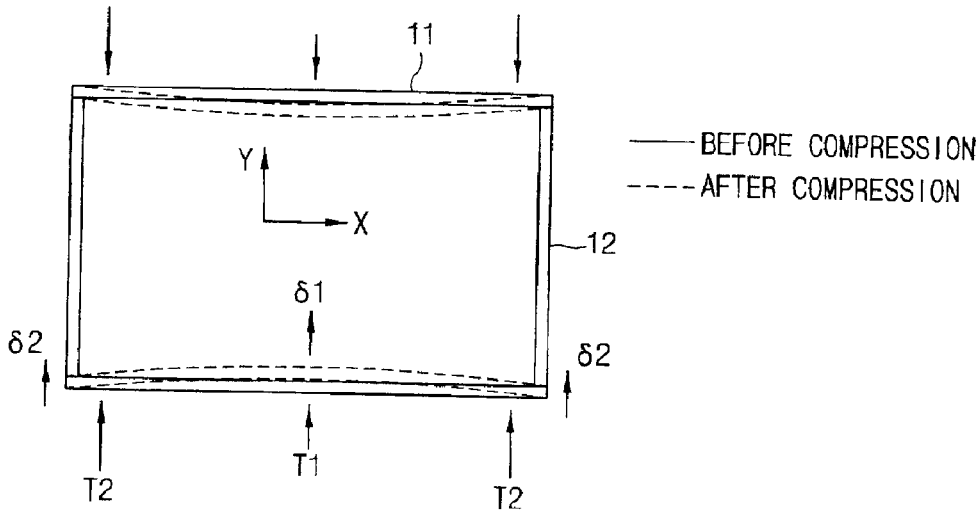
FIG.4A CONVENTIONAL ART
FIGS. 4A, 4B and 4C are schematic views and graphs showing compression load and displacement of a supporting frame structure for a shadow mask according to according to a conventional art.
Figure 4B:
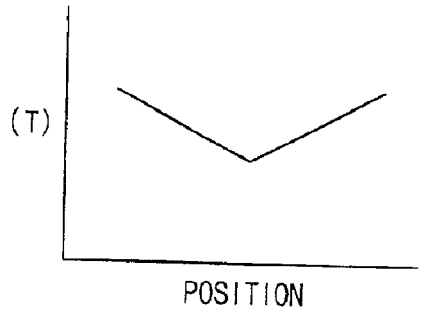
FIG.4B CONVENTIONAL ART
Figure 4C:
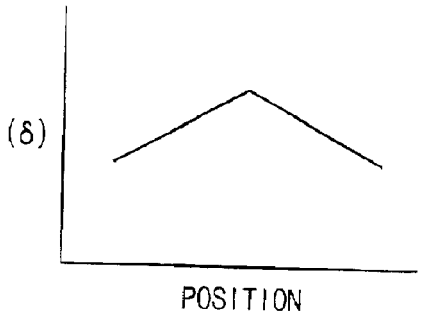
FIG.4C CONVENTIONAL ART
Figure 5:
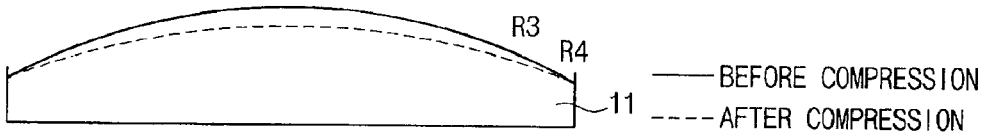
FIG.5 CONVENTIONAL ART
FIG. 5 is a detailed view showing a radius of curvature and curvature structure of a supporting frame structure for a shadow mask before and after frame compression according to a conventional art.
Figure 6:
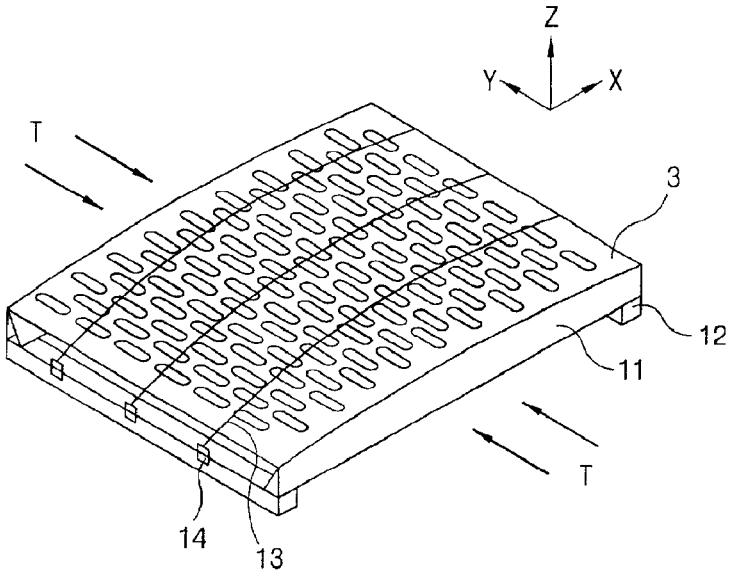
FIG.6 CONVENTIONAL ART
FIG. 6 is a perspective view showing a structure combined with a general damper wires.
Figure 7:
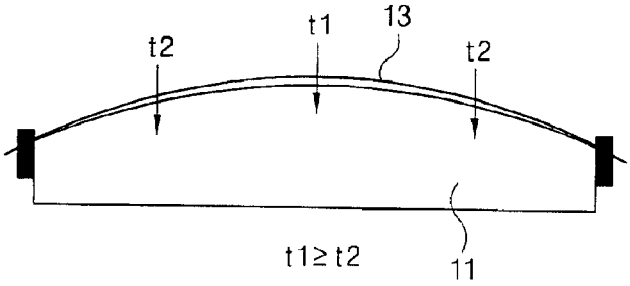
FIG.7 CONVENTIONAL ART
FIG. 7 is a schematic view showing elastic force of the conventional damper wire.
Figure 8A:
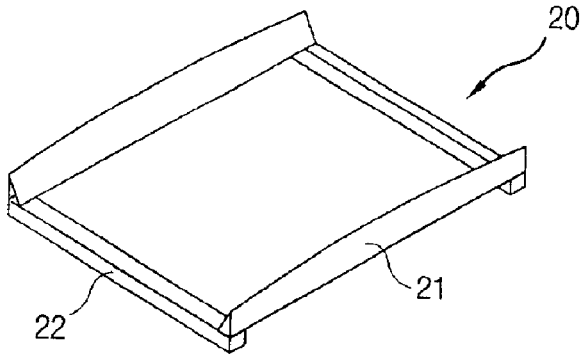
FIGS. 8A and 8B are a perspective view showing a supporting frame structure for a shadow mask and a structure of a curvature before compression on a main frame in accordance with the present invention.
Figure 8B:
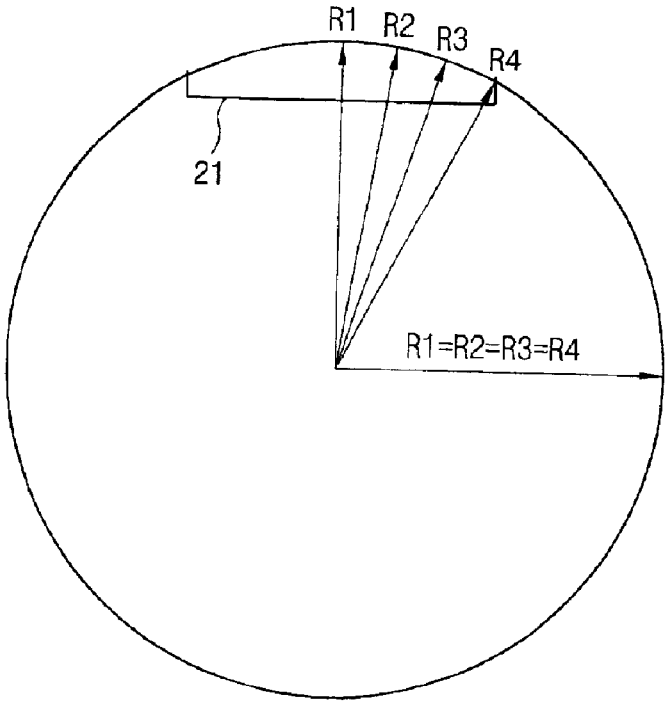

FIGS. 8A and 8B are a perspective view showing a supporting frame structure for a shadow mask and a structure of a curvature before compression on a main frame in accordance with the present invention.

Figure 9A:
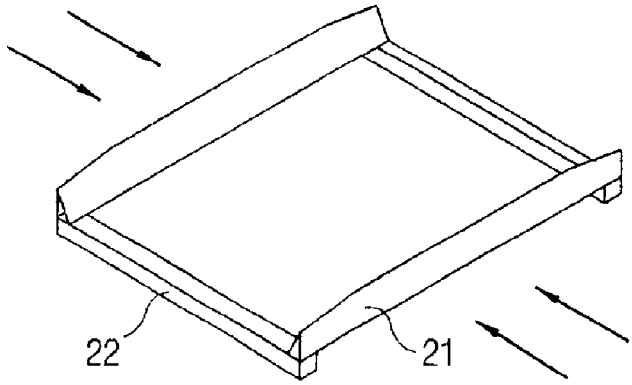
FIGS. 9A and 9B are a perspective view showing a supporting frame structure for a shadow mask and a structure of a curvature describing effect of compression force of damper wire in accordance with the present invention.
Figure 9B:
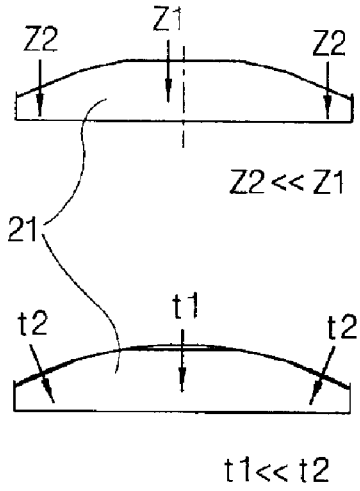

FIGS. 9A and 9B are a perspective view showing a supporting frame structure for a shadow mask and a structure of a curvature describing an effect of compression force of a damper wire in accordance with the present invention.

Figure 10:
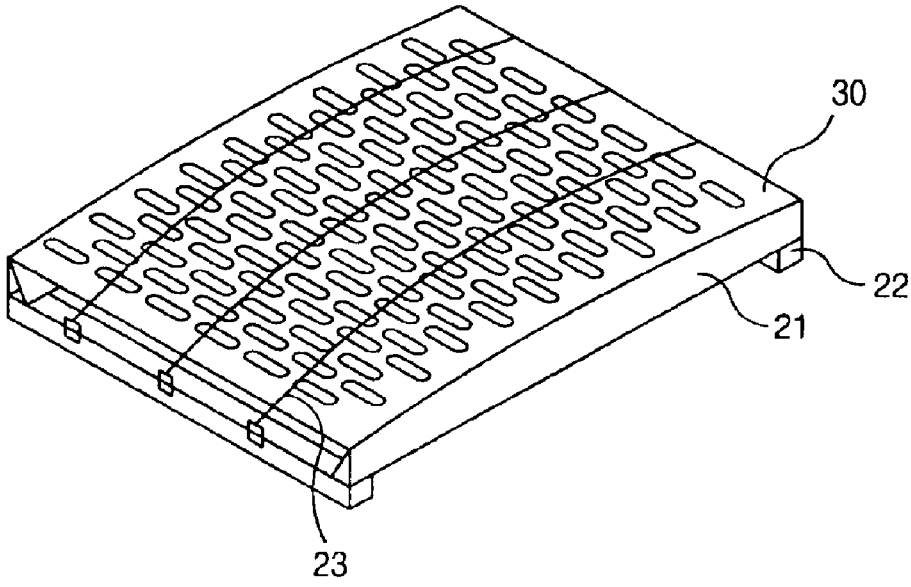
FIG. 10 shows a shadow mask according to the present invention.

A frame 20 is comprised of a pair of main frames 21 for supporting a shadow mask 30 (see FIG. 10), and a pair of sub frames 22 combined with the main frame 21 for applying elastic force to the shadow mask 30 supporting the main frame 21 and according to the shadow mask assembly for a color CRT having upper and lower tensions, the curvature varies before and after compression of the frame 20.

Namely, by the difference in the compression displacement of the center portion and peripheral portions of the main frame 21 in case of compressing the main frame 21, the heights of the center portion and peripheral portions of the main frame 21 change in Z direction.

Namely, as shown in FIG. 9B, in case the displacement in Z axis at the central portion of the main frame 21 is Z1 and the displacement in Z axis at the peripheral portions of the main frame 21 is Z2, the height of the main frame 21 in Z direction varies satisfying the relation Z1>Z2.

Therefore, since the size of the radius of the curvature of before and after compression and curvature structure change, when the shadow mask assembly is manufactured, it is necessary to strengthen the damper wire 23 at the peripheral portions of the main frame 21.

Therefore, to make an inflection point around the peripheral portions of the main frame 21 after compressing the main frame 21, the radius of curvature of the main frame 21 is formed in the structure of a single curvature identically according to the position of the main frame 21 and accordingly before the compression, the change of position in Z direction can be provided with a curvature inflection point through the relative difference of the height of the main frame 21.

At this time, the radius of curvature of the main frame 21 is a single radius of curvature in case tension applied to the shadow mask 30 is removed in the structure of the shadow mask assembly.

As shown in FIG. 8B, the single radius of curvature means that the radius of curvature in every position of the main frame 21 is identical and the single radius of curvature in accordance with the present invention means that the R which is a representative single curvature obtained by connecting the center of the shadow mask supporting portion of the main frame 21 and both ends of the main frame 21 and ΔR which is a radius of curvature obtained by connecting three arbitrary positions in the main frame 21 and the curvature structure of the shadow mask supporting portion in the main frame 21 satisfies the equation:

$$\Delta R/R=0.95\sim1.05$$

The ratio ΔR/R includes a tolerance range for manufacturing the main frame 21 mechanically and, after compression, required dual curvature can be obtained.

Also, by forming the structure of the curvature of the main frame 21 as a single structure before compression, namely, by having the same radius of curvature in every position of the main frame 21, the structure of curvature of the main frame 21 due to the difference of the compression displacement of the center portion and the left and right peripheral portions in case of compressing the frame and an inflection point of the curvature by the difference of the compression displacement in case of compressing the frame and welding the shadow mask.

As apparent from the above, according to the present invention, the diminishing function of the damper wire can be increased by increasing the contact force at the peripheral portion of the shadow mask to thus improve the howling phenomenon, and in case of manufacturing the main frame mechanically, the cost for manufacturing in a single curvature form is less than that for manufacturing processing in a poly-nomial form.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A frame for supporting a tension-type shadow mask of a color CRT comprising:

a pair of first frames, each having a portion for supporting a shadow mask, respectively; and a pair of second frames combined with the first frames for applying elastic force to the shadow mask, wherein each of the portions for supporting in the first frames has inflection points where the curvature of the portions for supporting is increased at peripheral portions thereof after the first frames are compressed, for supporting the shadow mask and increasing a friction force of a damper wire at the periphery of the shadow mask.

2. The frame according to claim 1, wherein each of the portions for supporting in the first frames has the inflection points at the peripheral portions thereof in a state that the shadow mask is supported on the portions for supporting in the first frames.

3. The frame according to claim 1, where each of the portions for supporting in the first frames has a single radius of curvature in case that all the elastic forces applied to the first frames are removed.

4. The frame according to claim 3, wherein the radius of curvature of the portions for supporting satisfies the equation ΔR/R=0.95~1.05, where R is a radius of curvature obtained by connecting a center and both ends of each one of the portions for supporting in the first frames, and ΔR is a radius of curvature obtained by connecting three arbitrary positions of each one of the portions for supporting in the first frames.

* * * * *